US005307132A

United States Patent [19]

Tsuchiya

[11] Patent Number: 5,307,132

[45] Date of Patent: Apr. 26, 1994

[54] IMAGE FORMING APPARATUS HAVING A CONTROLLER FOR DISCHARGING AIR IN RESPONSE TO A HEATING CONDITION OF AN IMAGE FIXING DEVICE

[75] Inventor: Hiroaki Tsuchiya, Yokohama, Japan

[73] Assignee: Canon Kabushiki Kaisha, Tokyo, Japan

[21] Appl. No.: 829,573

[22] Filed: Feb. 3, 1992

Related U.S. Application Data

[63] Continuation of Ser. No. 477,170, Feb. 8, 1990, abandoned, which is a continuation of Ser. No. 269,701, Nov. 10, 1988, abandoned.

[30] Foreign Application Priority Data

Nov. 12, 1987 [JP] Japan ..... 62-286084

[51] Int. Cl.[5] ..... G03G 15/20; G03G 21/00

[52] U.S. Cl. ..... 355/284; 355/215; 355/285

[58] Field of Search ..... 355/215, 282, 283, 285, 355/30, 284

[56] References Cited

U.S. PATENT DOCUMENTS

| | | | |
|---|---|---|---|
| 3,901,591 | 8/1975 | Mitsumasu | 355/282 |
| 4,178,092 | 12/1979 | Yamamoto et al. | 355/200 |
| 4,202,618 | 5/1980 | Waschk et al. | 355/215 X |
| 4,384,783 | 5/1983 | Sakata et al. | 355/285 X |
| 4,401,385 | 8/1983 | Katayama et al. | 355/299 |
| 4,462,675 | 7/1984 | Moraw et al. | 355/285 |
| 4,469,432 | 9/1984 | Miyoshi et al. | 355/285 |
| 4,693,588 | 9/1987 | Yarbrough et al. | 355/282 |
| 4,720,727 | 1/1988 | Yoshida | 355/215 |

FOREIGN PATENT DOCUMENTS

| | | | |
|---|---|---|---|
| 167716 | 1/1986 | European Pat. Off. . | |
| 2653486 | 6/1978 | Fed. Rep. of Germany . | |
| 3026969 | 2/1981 | Fed. Rep. of Germany . | |
| 2293003 | 6/1976 | France . | |
| 58-24173 | 2/1983 | Japan . | |
| 58-102968 | 6/1983 | Japan . | |
| 60-37579 | 11/1983 | Japan . | |
| 58-194048 | 11/1983 | Japan | 355/282 |
| 59-49571 | 3/1984 | Japan . | |
| 59-152474 | 8/1984 | Japan | 355/285 |
| 61-193173 | 8/1986 | Japan . | |
| 62-43664 | 2/1987 | Japan . | |
| 62-148986 | 7/1987 | Japan | 355/285 |
| 62-175785 | 8/1987 | Japan | 355/285 |
| 62-175786 | 8/1987 | Japan | 355/285 |
| 62-175788 | 8/1987 | Japan | 355/285 |
| 62-175789 | 8/1987 | Japan | 355/285 |
| 62-206574 | 9/1987 | Japan | 355/285 |

*Primary Examiner*—Fred L. Braun

*Attorney, Agent, or Firm*—Fitzpatrick, Cella, Harper & Scinto

[57] ABSTRACT

An image forming apparatus include an image forming device for forming a toner image on a recording material. The image forming device includes an electrical discharger, a fixing device for fixing the toner image with heat, and a air discharging device for discharging air between the fixing device and electrical discharger in the apparatus. The fixing device includes a heated roller having a surface on which a parting agent is applied to facilitate separation of the recording sheet from the roller. A controller controls the air discharging device in accordance with a heated state of the surface of the roller.

12 Claims, 7 Drawing Sheets

IMAGE FORMING APPARATUS HAVING A CONTROLLER FOR DISCHARGING AIR IN RESPONSE TO A HEATING CONDITION OF AN IMAGE FIXING DEVICE

This application is a continuation of U.S. patent application Ser. No. 07/477,170, filed Feb. 8, 1990, now abandoned, which in turn is a continuation of U.S. patent application Ser. No. 07/269,701, filed Nov. 10, 1988, now abandoned.

FIELD OF THE INVENTION AND RELATED ART

The present invention relates to an image forming apparatus such as an electrophotographic copying apparatus provided with discharging means and heat fixing means, more particularly to an image forming apparatus provided with an air discharging function for discharging the air in the apparatus.

Conventionally, most image forming apparatuses, such as copying machines, optical printers and electrophotographic copying machines, are provided with electrical discharging devices actable on image bearing members. For the discharging devices, use is widely made of corona discharging devices having a corona wire to which a high voltage, such as several KV, is applied to effect corona discharge. The types of corona discharging devices include generally a corotron type and scorotron type. The corotron type discharger includes a shielding plate made of conductive material and a discharge wire enclosed therewith and made of a conductive fine wire having a diameter such as 50–100 microns, wherein a high voltage is applied to the discharging wire to produce corona discharge by which a member is charged or discharged by the ions electrolytically dissociated by the corona discharge. The scorotron type discharger includes, in addition to the elements of the corotron type discharger grid, wires between the discharging wire and the member to be charged or discharged.

In such corona dischargers, particularly those having the discharging wire, the corona discharging wire is contaminated due to the dust collecting effects inherent in the discharge. The contamination deteriorates the discharging properties thereby causing non-uniform charging and discharging, or producing abnormal discharging with the possible result of damage to the member to be charged or discharged. Since the service life of the corona discharging device is significantly dependent on the contamination of the corona discharging wire, various measures have been taken to present contamination.

For example, the corona discharging device can be accommodated in a hermetically sealed casing shield. However, since then there is no supply of molecules to be dissociated by the corona discharge, the discharge efficiency decreases thereby deleteriously affecting the discharging properties. In addition, it is practically difficult to constitute the sealed system. For example, it would be possible to minimize the gap between the shielding plate and the member to be charged, but it is still not possible to completely seal it. Through the gap, corona wind resulting from the corona discharge is exhausted to provide a negative pressure in the discharger, which causes the introduction of the air, which in turn introduces foreign matter contaminating the discharging wire.

Thus, it has been found that the problems in the corona discharging device are not solved by the sealed enclosure.

Another measure to minimize contamination is supply of air into the discharger. It is a premise in this case that the foreign matter is removed beforehand using a dust filter, an electrostatic filter, or the like. This method is efficient in that the discharge efficiency can be maintained high and in that the air flow in the discharger is one way. For those reasons, it has been widely used in various types of machines. However, there is a limit to the amount of foreign matter that can be removed by the filter or filters, because the foreign matter includes a developer, paper dust produced from the recording sheets, smoke of cigarettes, vapor of silicone oil used in the image fixing apparatus and silicone gas produced from the silicone rubber material used in the apparatus. In an attempt to solve the problem of the foreign matter removal, it has been considered to use a thick filter or a more highly packed filter, which, however, imposes a heavier load on the air fan. In addition, there is a problem of service life of the filter due to the clogging of the filter. Thus, this measure to prevent the contamination of the discharging wire has been very difficult to successfully implement.

In view of the above, a means is considered to prevent deterioration of the charging properties, while permitting some contamination of the discharging wire. First, it is considered that discharging current is increased. By doing so, the clearance between the discharging wire and the photosensitive member can be increased, so that the non-uniformity can be decreased. Another method of this type is to increase the density of the grid or employ a grid in the form of a mesh to supply a larger corona current to the grid to decrease the non-uniformity. Another method proposed is to apply an alternating voltage to the discharging wire or the shielding plate to decrease the non-uniformity. However, with the current increased, there are risks of abnormal discharge, current leakage and increase of production of ozone and NOx. The problem of larger voltage source for the high voltage is also involved. The increase in the current results in an increased dust collecting effect, which worsens the contamination of the discharging wire and the shielding plate. The application of the alternating voltage makes the structure of the apparatus more complicated.

Then, in order to extend the service life of the discharging wire, it is practiced to manually or automatically clean the discharging wire with cleaning means. However, it is not easy to remove the foreign matter by the cleaning means because the developer, the smoke molecules, silicone gas, or the like are oxidized by the dissociation energy of the corona discharge and are strongly deposited on the discharging wire.

Another proposal has been made in which a fresh discharging wire is automatically supplied to replace the contaminated discharging wire, which, however increases the size and the cost of the apparatus.

Apart from those considerations, the provision of the fan is considered and practiced to prevent an increase of temperature in the apparatus or to discharge corona discharge products such as ozone and NOx. As for the measure against the temperature rise, a heat removing fan is disposed adjacent the image fixing apparatus, for example, which is actuated or deactuated in synchronism with the turning on and off of the power source. In this system, when the main switch is turned off, the fan is deenergized even if the image fixing apparatus is in a high temperature state. If the temperature in the apparatus is low, the air is not discharged even if the image fixing device is being heated.

It has been found that among the contamination matters, what is most attributable to the non-uniform discharge or the abnormal discharge is silicon oxide ($SiO_2$), by investigating and analyzing the material deposited on the discharging wire.

In addition, it has been found that when the image fixing device is of a heating roller type wherein silicone oil is applied to the roller or rollers used thereon, or when the roller has a silicone rubber layer, the discharging wire is contaminated strongly. It is understood that this is because the silicon vapor from the silicone rubber or the silicone oil is deposited on the discharging wire and is oxidized by the corona discharge energy to produce $SiO_2$. This is intense when the oil applied contains dimethylsiloxane. Therefore, the deposition of the silicone vapor to the discharging wire is not effectively prevented by the heat discharging fan.

The deposition of the silicone vapor onto the discharging wire is not prevented by a fan for discharging the corona products.

SUMMARY OF THE INVENTION

Accordingly, it is a principal object of the present invention to provide an image forming apparatus wherein an erroneous discharging action does not occur, and therefore, the image forming operation is stabilized.

It is another object of the present invention to provide an image forming apparatus in which an erroneous discharging action does not occur even when silicone oil and/or silicone rubber is used in an image forming apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
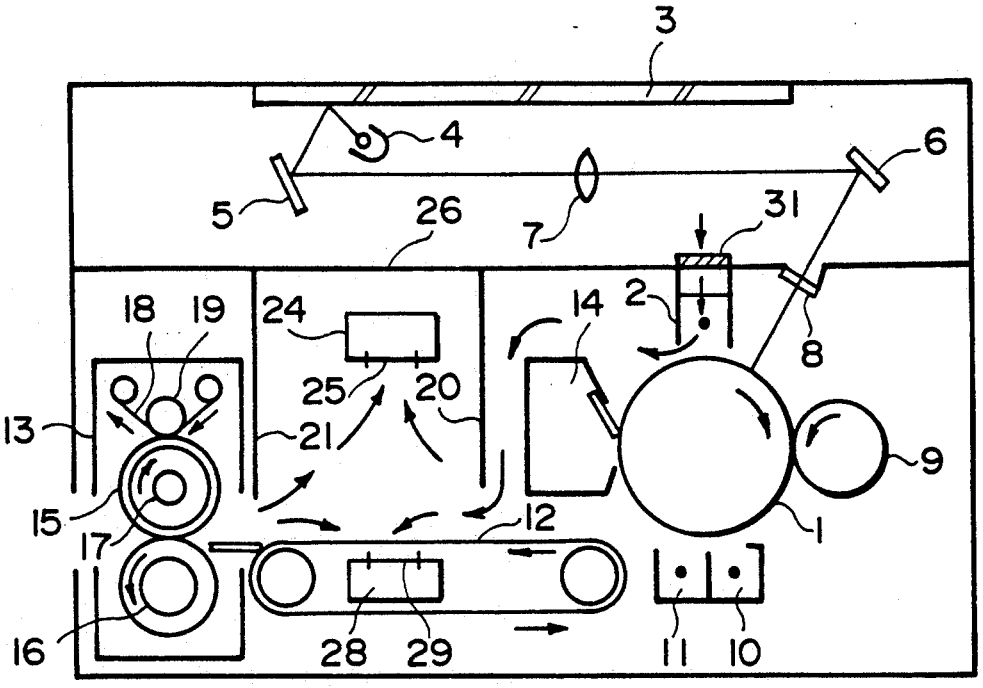
FIG. 1 is a sectional view of an image forming apparatus according to an embodiment of the present invention.

In the accompanying drawings, like reference numerals have been assigned to corresponding elements.

Figure 2:
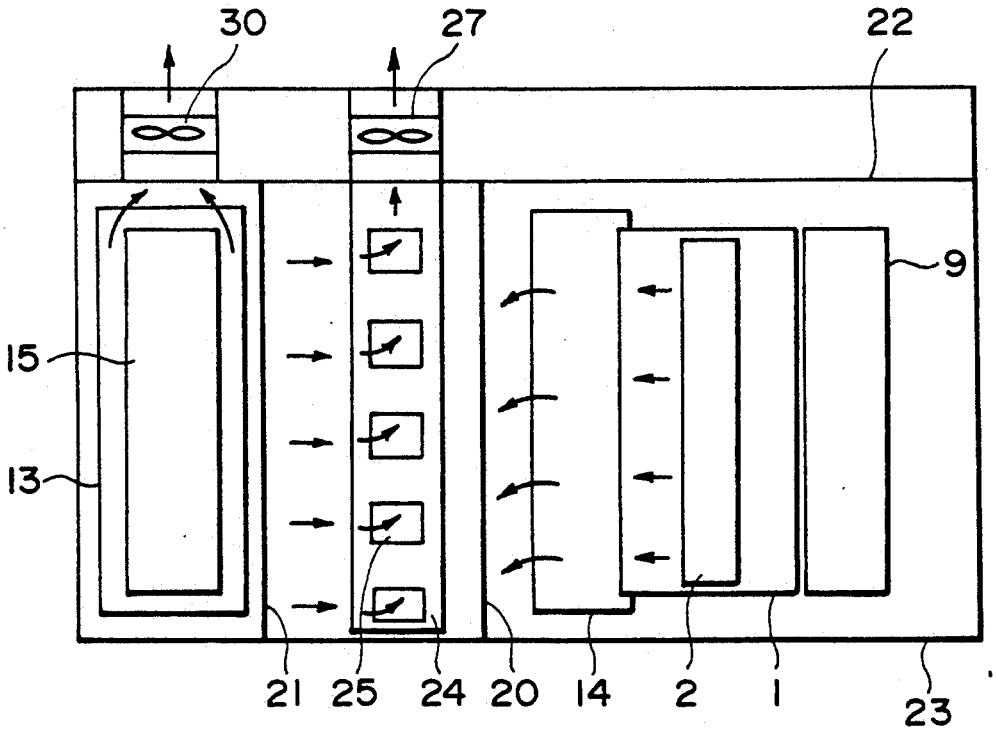
FIG. 2 is a top plan view of the apparatus of FIG. 1.

Referring to FIG. 1, there is shown a copying machine according to an embodiment of the present invention in a cross-section. FIG. 2 is a top plan view illustrating flow of air in the apparatus of FIG. 1. The copying machine comprises a photosensitive drum 1, a primary charger 2 having a discharging wire and a shield, an original supporting platen 3, an illumination device 4, mirrors 5 and 6, a lens 7, a dust-proof glass 8, a developing device 9, a transfer charger 10, a separation charger 11, a conveying belt 12, a fixing device 13 and a cleaning device 14.

In operation, the photosensitive drum 1 is rotated in the direction indicated by the arrow thereon, during which it is uniformly charged by the primary charger 2. The original on the original supporting platen glass 3 is illuminated by an illuminating device 4, and an image thereof is formed on the photosensitive member 1 by way of the mirrors 5 and 6, the lens 7 and the dust-proof glass 8, so that an electrostatic latent image is formed on the photosensitive drum. The latent image is visualized by the developing device 9 and the toner image produced by the development is transferred onto a recording sheet by a transfer charger 10. The recording sheet is then separated by the separation charger 11 from the photosensitive drum 1 and is carried on the conveying belt 12 to the fixing device 13. By this operation, the toner image on the recording sheet is fixed. The photosensitive drum 1 is cleaned by the cleaning device 14 and is used for repeating the above steps.

In the apparatus described above, the image fixing device 13 includes an upper roller 15 contactable to the unfixed toner image and a lower roller 16 for backing up the upper roller 15. The upper roller 15 includes a cylindrical metal (aluminum, for example) and a coating layer of fluorine resin such as PFA and PTFE. The upper roller 15 contains a heater 17 therein. The lower roller 16 is a back-up or pressing roller having a core metal and a silicone rubber layer. In order to clean the fixing roller 15, a web cleaning 18 is employed, and is impregnated with silicone oil. It is movable in a direction indicated by an arrow and is press-contacted to the upper roller 15 by the web roller 19 so as to clean the surface of the upper roller 15 and to apply the silicone oil as a releasing agent on the surface of the upper roller 15.

The copying apparatus includes an image forming station equipped with corona discharging devices 2, 10 and 11, wherein the charging, exposure, developing and image transfer steps are sequentially carried out to form a developed image on the recording sheet, and with an image fixing station which receives the recording sheet having the developed image and which fixes the developed image. The silicone oil used in the image fixing apparatus is heated to become vapor and reaches the discharging device, where it is deposited on the discharging wire and is changed to a silicone oxide by the corona discharging action thereof. Therefore, this causes non-uniform discharge and abnormal discharge.

This embodiment provides a solution to this problem.

As shown in FIG. 2, an exhausting fan 27 for discharging the air in the apparatus is provided, in addition to a heat discharging fan 30 for preventing overheating of the image fixing station.

Between the image fixing station and the image forming station, a duct 24 is disposed having an opening 25. The duct is connected to the exhausting fan 27. The exhausting fan 27 serves to discharge the vapor produced by the image fixing operation, particularly, the silicone oil vapor to the outside of the apparatus, thus preventing the vapors from reaching the discharger. Within the circulation path of the conveying belt 12, a duct 28 is disposed having an opening 29 and is connected to another exhausting fan not shown. In this embodiment, there are provided partition walls 20 and 21 for isolating the introduction and discharge of the air between the image forming station including the discharging portions around the photosensitive drum 1 and the image fixing station 13. The partition walls 20 and 21 are connected to the side plates 22 and 23 of the apparatus. By the provision of partition walls 20 and 21, the vapors produced in the image fixing station are further prevented from reaching the discharging portion. In addition, the air between the partition walls 20 and 21 is discharged, and therefore, the vapors produced at the image fixing station and passing beyond the partition wall 21 are discharged to the outside, and therefore, the vapors do not reach the discharging portion.

Figure 3:
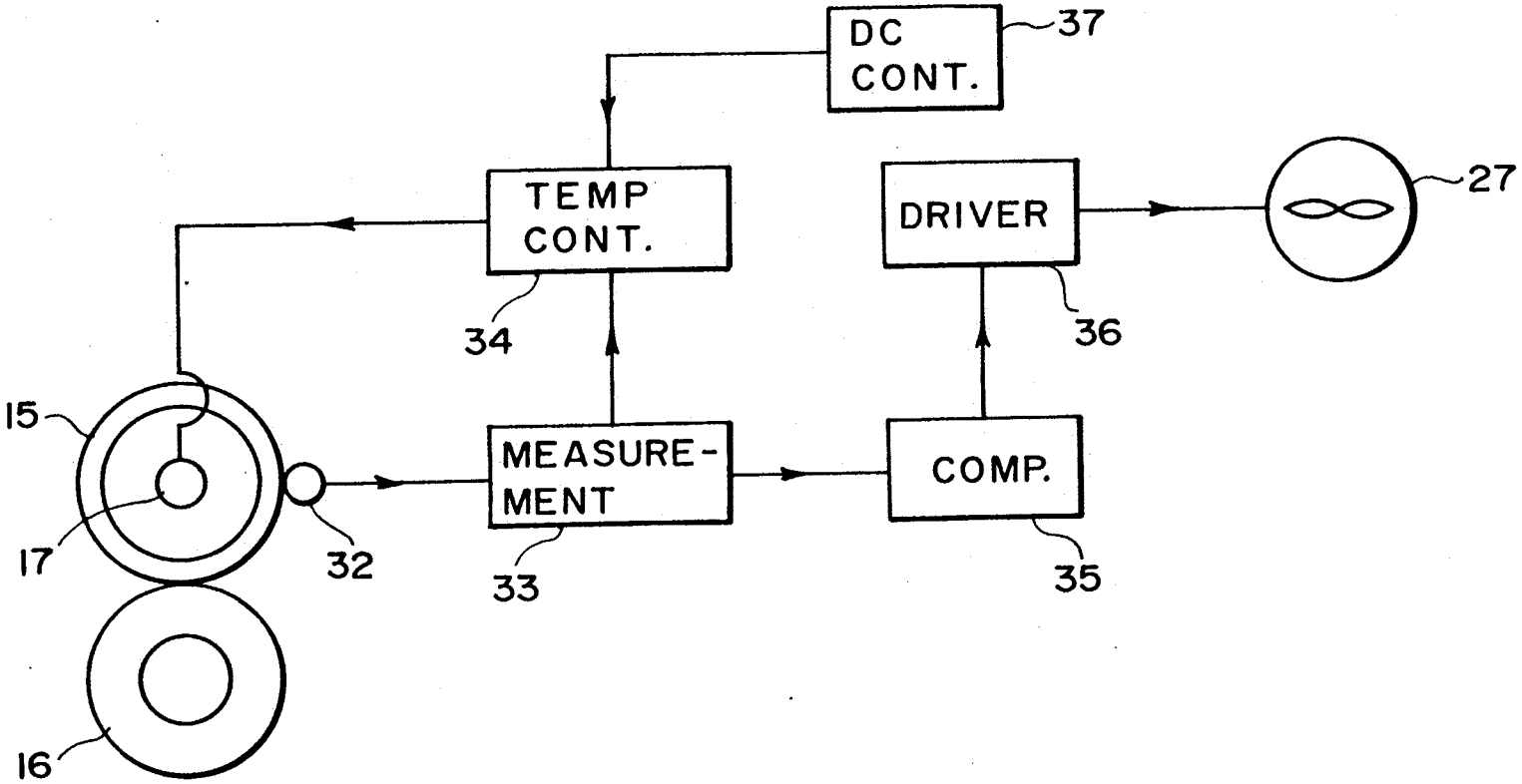
FIG. 3 is a block diagram illustrating a discharge fan driving mechanism.

The operation of the discharging fan 27 will be described. FIG. 3 is a block diagram of a driving mechanism for the discharging fan. The driving mechanism includes a temperature sensor 32 in the form of a thermistor or the like for detecting the temperature of the fixing roller, a measuring circuit 33, a temperature controlling circuit 34, a comparing circuit 35, a driving circuit 36 for the discharging fan 27 and a DC controller 37. In this mechanism, the temperature sensor 32 detects the surface temperature of the image fixing roller and transmits it to the measuring circuit 33. The output from the measuring circuit 33 is inputted into the temperature control circuit 34, where the current supply to the heater 17 of the fixing roller is controlled. The output of the measuring circuit 33 is supplied to the comparing circuit 35 where it compares the surface temperature of the fixing roller with a predetermined temperature, and a driving signal 36 for driving the discharging fan 27 is produced. The temperature control circuit 34 receives a signal indicative of the stand-by state from the DC controller 37.

Referring to FIGS. 4–8, the operational timing of the discharging fan will be described.

Figure 4:
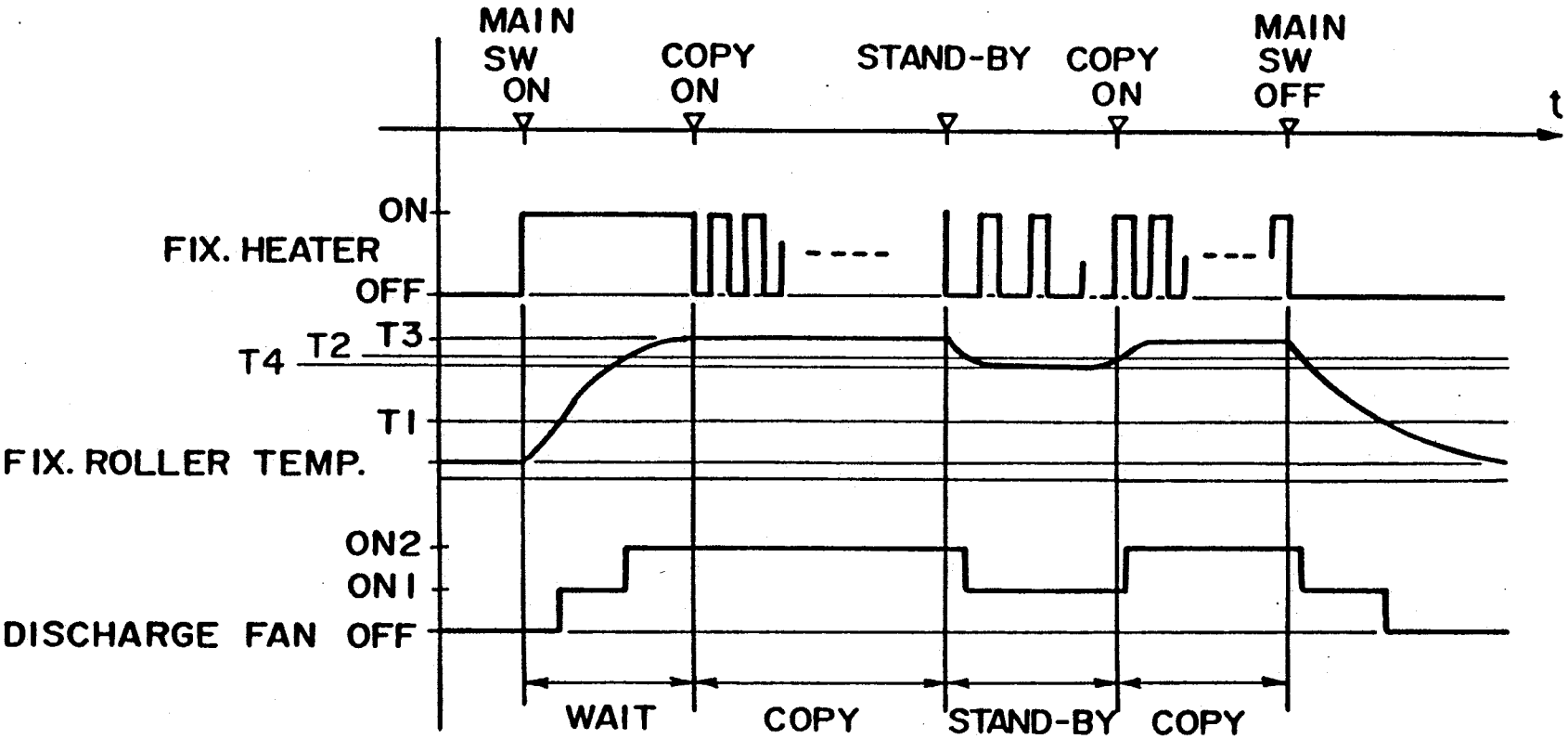
FIGS. 4–8 are timing diagrams illustrating the operational timing of the discharging or exhausting fan.

FIG. 4 shows operational timing in an apparatus according to a preferred embodiment wherein the exhausting fan output is controlled at two levels in accordance with the temperature level of the image fixing roller. In this FIG., a reference ON1 designates rotation of the exhausting fan at two thirds of the maximum rotational speed thereof, whereas reference ON2 designates rotation of the exhausting fan at the maximum rotational speed.

In FIG. 4, when the main switch of the apparatus is turned on, the image fixing heater 17 is energized. In this embodiment, the wattage of the heater is 800 W. With the actuation of the main switch, the surface temperature of the image fixing roller increases through T1 (70° C., for example) and T2 (150° C., for example) to T3 (185° C., for example). The heater 17 is kept energized until the temperature T3 is reached. After it is reached, the heater is on-off-controlled so that the temperature thereof is maintained at T3. When the surface temperature of the fixing roller reaches T1 (70° C.), the exhausting fan is energized by the level ON1 so that it is rotated at the speed ⅔ the maximum rotational speed. When the surface temperature of the fixing roller reaches T2 (150° C.), the exhausting fan is energized by the level ON2 so that the rotational speed becomes maximum, thus increasing the exhausting power. If the copying machine is in on-state, the discharging fan continues this state. When the apparatus enters the stand-by state, the surface temperature of the image fixing roller is controlled to be T4 (140° C., for example) lower than the temperature T2. Since the surface temperature of the fixing roller is now lower than T2, the energy supply level to the exhausting fan becomes ON1. If, the copying operation is instructed, the discharging fan is operated at level ON2 depending on the temperature of the fixing heater. When the main switch is turned off, the surface temperature of the fixing roller decreases. During the decrease, the discharging fan becomes operated to ON1 when the temperature is lower than T2, and is turned off when the temperature is not less than T1. The temperatures T1 and T2 may be selected properly in accordance with the structure, configuration and material of the fixing device. Also, consideration is made of the characteristics of the vapors produced by the used silicone rubber roller and the silicone oil. Generally, when a low viscosity oil is used, it is preferable that the temperatures T1 and T2 are relatively low. In this embodiment, the web is impregnated with silicone oil having a viscosity 10,000 CS at a normal temperature. The viscosity of the silicone oil decreases with increase of the temperature, and the vapor pressure increases with the temperature. The viscosity of the silicone oil can be adjusted by mixing with another oil having different viscosity. Those factors are to be considered together with other conditions of the apparatus, when the temperatures T1 and T2 are determined. It is preferable that the temperature T2 is slightly higher than the stand-by temperature when the apparatus has the stand-by temperature T4.

In this embodiment, the exhausting fan in the conveying station is preferably operated in the similar manner as the fan 27.

By those fans, the air flow in the apparatus is as shown in FIGS. 1 and 2, and more particularly, two flows are established. One is the flow from the inlet of the image fixing device to the opening of the duct, and the other is the flow from the dust proof filter 31 to the opening of the duct through the primary charger. The second flow is effective to force to the duct opening the air flow produced by the corona wire by the primary charger along the upper part of the cleaner. When the primary charger is not operated (stand-by period), the discharge from the primary charger is weak or zero.

The partition walls 20 and 21 may be movable away from the conveying path so as to facilitate a jam clearance operation when the recording sheet is jammed in the conveying path. It is not inevitable to provide both of upper and lower ducts, but sufficient effects can be provided only by the lower duct 28, although the deposition of the vapor on the discharging wire can be prevented assuredly by using both of the ducts.

Figure 5:
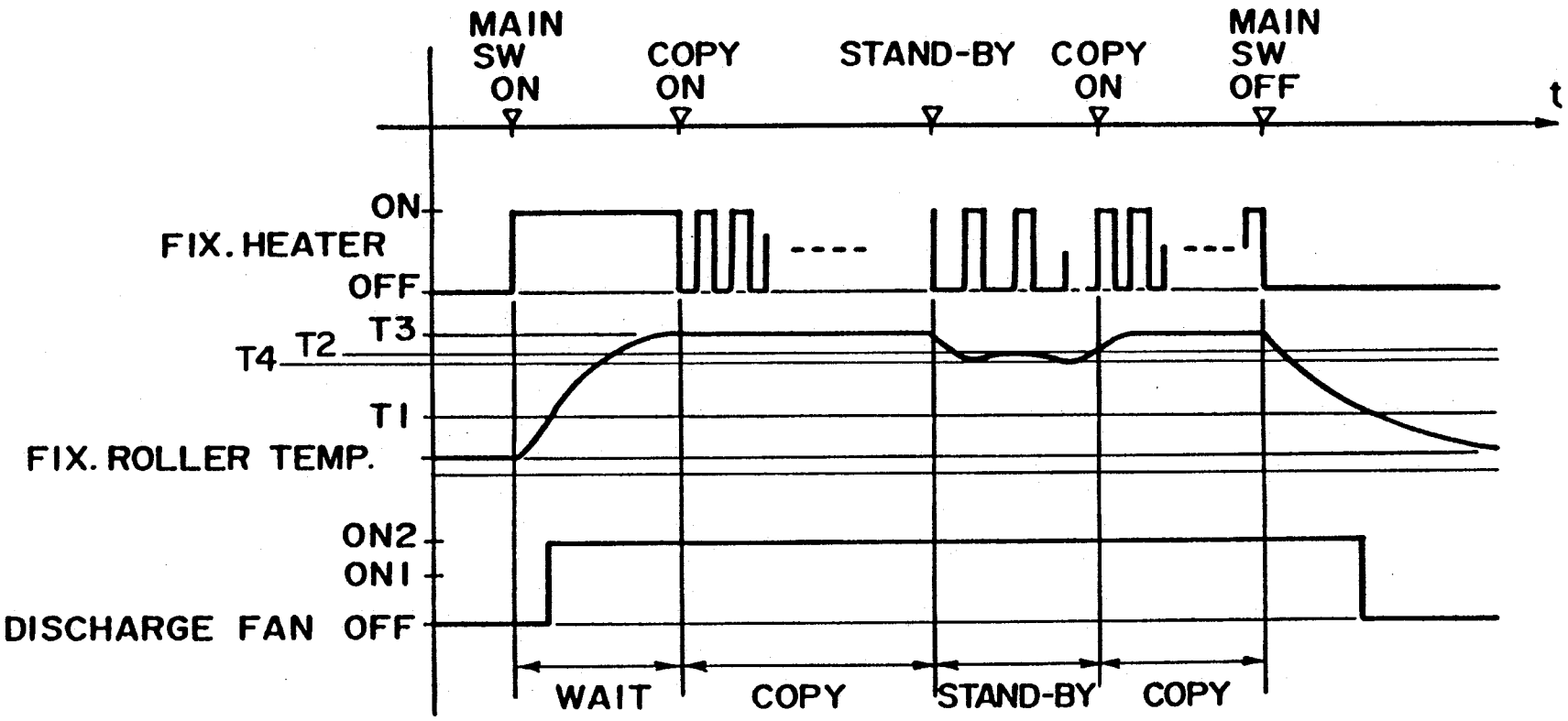

Referring to FIG. 5, there is shown another embodiment of a sequential operation of an exhausting fan. In this embodiment, the exhausting fan is not operated at two levels, but the exhausting fan is always operated at level ON2 whenever the temperature of the fixing roller is at or above the temperature T1.

Figure 6:
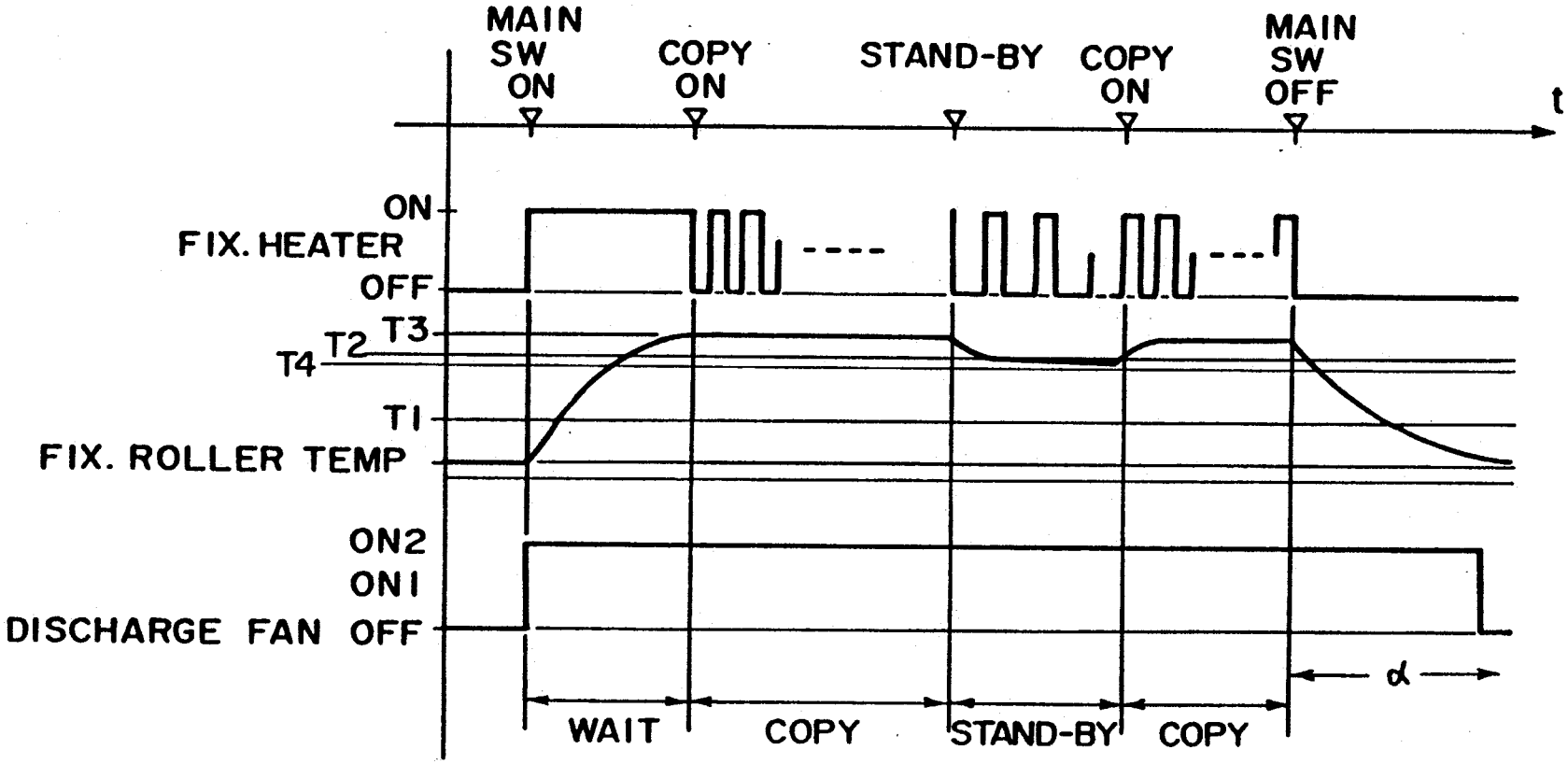
Figure 7:
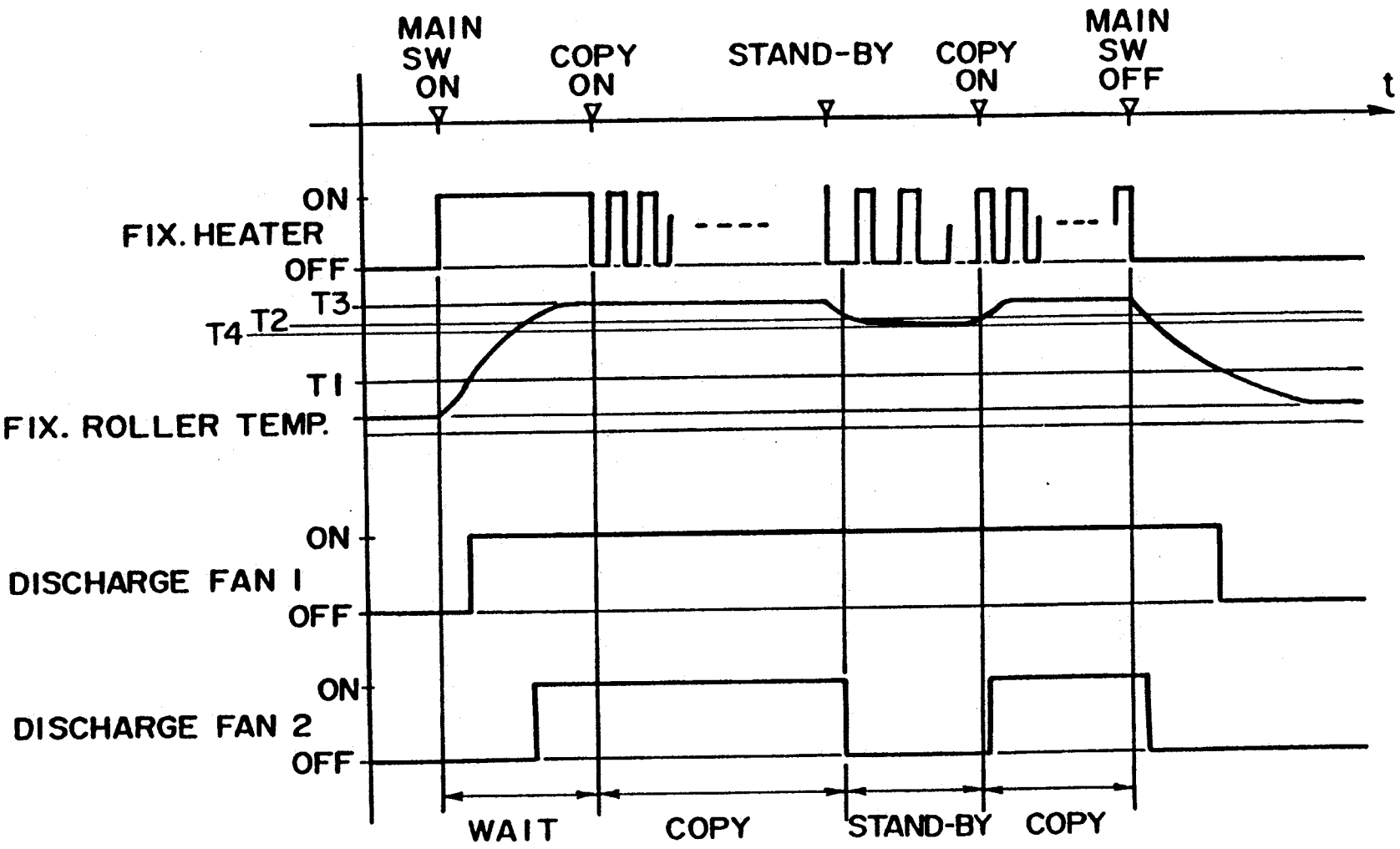

Referring to FIG. 6, another embodiment of the sequential operation is shown. In this embodiment, the operation of the exhausting fan is synchronized with the start of the energy supply to the fixing roller, and the operation of the exhausting fan is stopped a certain period ($\alpha$) after termination of the energy supply to the fixing roller. In this embodiment, the exhausting fan starts with actuation of the main switch, but is stopped for a certain period after the deactuation of the main switch. In this case, the driving circuit 36 of FIG. 3 receives on and off signals of the main switch and a signal from a timer circuit for measuring the time after the deactuation of the main switch. The time period $\alpha$ is determined so that the fixing roller is cooled sufficiently.

The drive of the fan may be controlled in accordance with the energy supply to the heater in the manner described above. Since, however, the actual surface temperature of the roller is different from the predicted temperature due to the change in the ambience and the deterioration of the heater, it is preferable that the surface temperature of the roller is actually detected, and the drive of the fan is controlled on the basis of the detected temperature.

It is possible that an auxiliary heater is provided adjacent the image fixing device in order to keep the temperature at a certain level during the main switch being off, although it is not shown in FIGS. 1 and 2.

Figure 8:
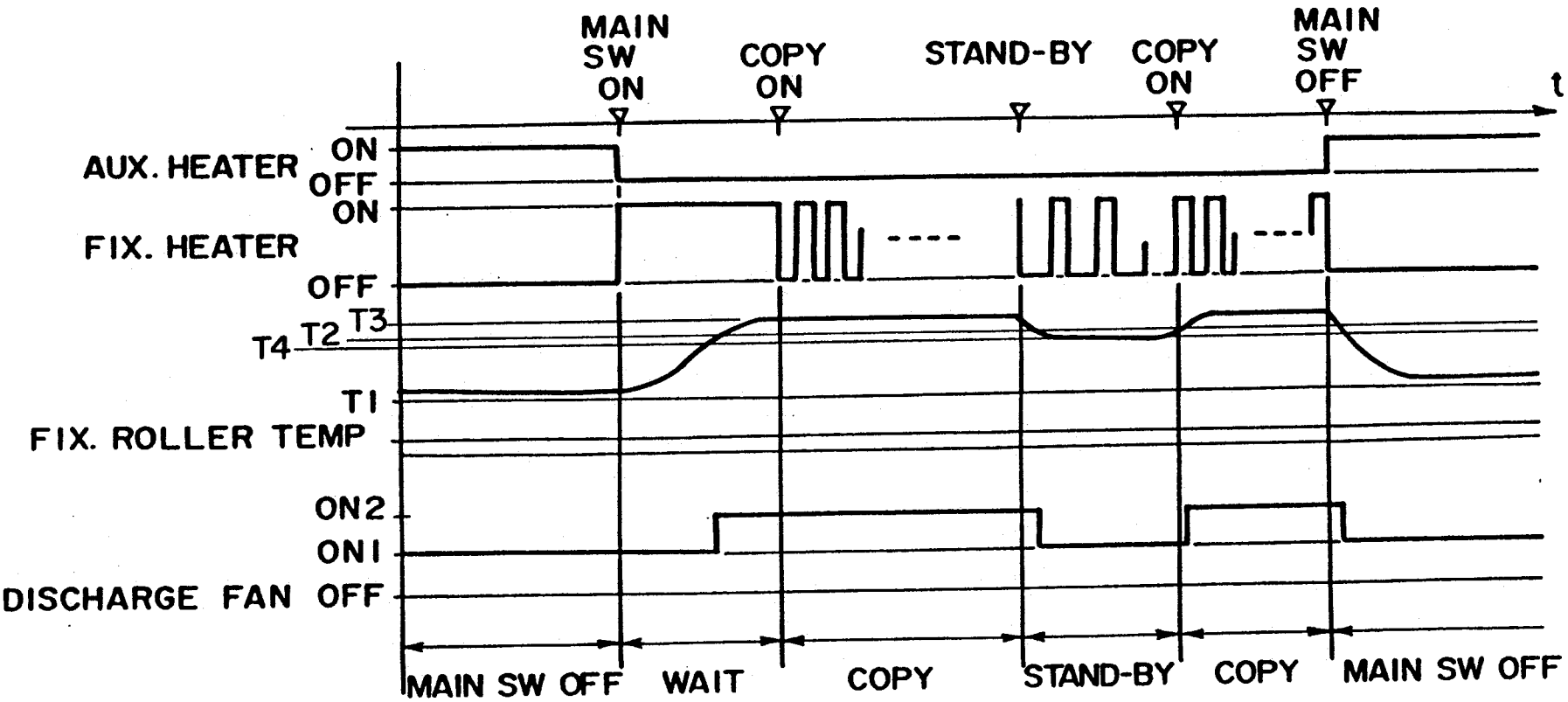

Referring to FIG. 8, there is shown a sequential operation for operating the exhausting fan which is provided with an auxiliary heater, according to another embodiment of the present invention. As will be understood from the FIG., the auxiliary heater is energized during the period in which the main switch is off; and the auxiliary heater becomes off when the main switch becomes on. The exhausting fan is operated at the level ON1 when the auxiliary heater is on, and is operated at the level ON2 when the apparatus is operated. Therefore, as long as the temperature is at or higher than the temperature T1 because of the provision of the auxiliary heater, the discharging fan is energized even during the main switch being off.

As described, according to the embodiments of the present invention, the silicone oil gases discharged from the inlet side of the image fixing apparatus are substantially sealed by the partition wall 20 and 21, and the gases are exhausted to the outside through the ducts 24 and 28 in accordance with the exhausting fan operating sequence. It is preferable that the upper part of the image fixing apparatus is provided with suitable heat discharging means.

In the embodiments, the controlling sections 33, 34, 35, 36 and 37 are operated with a DC voltage of 5 V, and when the main switch is deactuated, the AC source only is deactuated, while the DC source is kept on, so that a DC voltage of 5 V is maintained even if the main switch is deactuated. Therefore, the drive control for the exhausting fan is possible after the main switch is actuated.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming toner image on a recording material, aid image forming means including electrical discharging means;

fixing means for fixing the toner image, said fixing means including a rotatable heating member heated by heating means, a temperature detecting element contacting a surface of the rotatable heating member to detect and output a surface temperature, power supply control means for controlling a power supplied to said heating means in accordance with the output of said temperature detecting element, and applying means for applying a parting agent to the surface of said rotatable member;

air discharging means for discharging air between said electrical discharging means and said fixing means; and drive control means for controlling said air discharging means in accordance with the output of said temperature detecting element.

2. An apparatus according to claim 1, wherein said image forming means includes an image bearing member for bearing the toner image, and wherein said electrical discharging means uniformly charges the image bearing member.

3. An apparatus according to claim 1, wherein said electrical discharging means comprises a corona discharging wire supplied with a voltage.

4. An apparatus according to claim 1, further comprising heat discharging means for discharging heat from said fixing means.

5. An apparatus according to claim 1, wherein said drive control means drives said air discharging means at a higher speed during image forming operation than during a stand-by state.

6. An apparatus according to claim 1, wherein the parting agent comprises a silicone oil.

7. An apparatus according to claim 1, wherein said drive control means drives said air discharging means when the output of said temperature detecting element represents a temperature higher than a predetermined level.

8. An apparatus according to claim 7, wherein said power supply control mean controls said heating means to maintain the surface of said rotatable heating member substantially at a fixing temperature, said predetermined level being lower than the fixing temperature.

9. An apparatus according to claim 8, wherein said power supply control means controls said heating means to maintain the surface of said rotatable heating member substantially at stand-by temperature during a stand-by state of sad apparatus, said predetermined level being lower than the stand-by temperature.

10. An apparatus according to claim 1, wherein said drive control means drives said air discharging means at a first speed when the output of said temperature detecting element represents a temperature in a first predetermined range and drives said air discharging means at a second speed when the output of said temperature detecting element represents a temperature in a second predetermined range.

11. An apparatus according to claim 10, wherein said power supply control means controls said heating means to maintain the surface of said rotatable heating member substantially at a fixing temperature, said fixing temperature being the first predetermined range.

12. An apparatus according to claim 11, wherein said power supply control means controls said heating means to maintain the surface of said rotatable heating member substantially at a stand-by temperature during a stand-by state of said apparatus, said stand-by temperature being in the second predetermined range.

* * * * *

UNITED STATES PATENT AND TRADEMARK OFFICE

CERTIFICATE OF CORRECTION

PATENT NO. : 5,307,132

DATED : April 26, 1994

INVENTOR(S) : HIROAKI TSUCHIYA

It is certified that error appears in the above-identified patent and that said Letters Patent is hereby corrected as shown below:

COLUMN 1

Line 52, "present" should read --prevent--.

COLUMN 7

Line 51, "toner" should read --a toner--.
Line 52, "aid" should read --said--.

COLUMN 8

Line 32, "mean" should read --means--.
Line 40, "sad" should read --said--.
Line 55, "being" should read --being in--.

Signed and Sealed this

Thirty-first Day of January, 1995

Bruce Lehman

*Attest:*

BRUCE LEHMAN

*Attesting Officer*

*Commissioner of Patents and Trademarks*